US006752322B2

(12) United States Patent
Ehrsam et al.

(10) Patent No.: US 6,752,322 B2
(45) Date of Patent: Jun. 22, 2004

(54) METHOD OF CONSTRUCTING A RAIL TRACK ON A TRACK-RECEIVING CONCRETE SLAB

(75) Inventors: Jean Ehrsam, Clamart (FR); Yvan Skific, Paris (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/340,665

(22) Filed: Jan. 13, 2003

(65) Prior Publication Data

US 2003/0178500 A1 Sep. 25, 2003

(Under 37 CFR 1.47)

(30) Foreign Application Priority Data

Jan. 24, 2002 (FR) ..... 02 00897

(51) Int. Cl.[7] ..... E01B 9/38
(52) U.S. Cl. ..... 238/283; 238/5; 238/8
(58) Field of Search ..... 238/283, 382, 238/336, 5, 2, 7, 8, 6, 151, 152, 122, 287, 292, 306; 29/451, 460, 530; 404/73, 34; 249/86; 425/111; 264/228

(56) References Cited

U.S. PATENT DOCUMENTS 3,565,336 A * 2/1971 Eisses ..... 238/265
4,629,118 A * 12/1986 Langman ..... 238/107
5,788,153 A 8/1998 Ortwein
6,471,138 B1 * 10/2002 Blank et al. ..... 238/122

FOREIGN PATENT DOCUMENTS

| | | | | |
|---|---|---|---|---|
| DE | 8711451.8 U1 * | 9/1982 | ..... | B29C/27/02 |
| DE | 87 11 451 U | 12/1988 | | |
| DE | 196 04 887 A | 8/1997 | | |
| DE | 19604887 A1 * | 8/1997 | ..... | E01B/9/62 |
| GB | 468 182 A | 6/1937 | | |

* cited by examiner

*Primary Examiner*—Frantz F. Jules
(74) *Attorney, Agent, or Firm*—Sughrue Mion, PLLC

(57) ABSTRACT

A method of constructing a rail track on a track-receiving concrete slab provided with channels serving to receive the rails of the rail track, wherein, after the concrete forming the track-receiving slab has set, it comprises at least the following steps:

a) the stretches of rail are put in place above the channels in the track-receiving slab, each rail having a foot coated with a casing of resilient material; and b) the foot as coated with its casing is inserted into the channel by force.

8 Claims, 1 Drawing Sheet

METHOD OF CONSTRUCTING A RAIL TRACK ON A TRACK-RECEIVING CONCRETE SLAB

The invention relates to a method of constructing a rail track on a track-receiving concrete slab provided with channels serving to receive the rails of the rail track. The invention is particularly applicable to constructing rail tracks for a subway or a tramway.

BACKGROUND OF THE INVENTION

Methods of constructing rail tracks are known that use a track-receiving concrete slab, such methods being increasingly frequently used because they make it possible for the rate of construction of the track-receiving slab to be very fast. In such methods, wet concrete is generally continuously cast by an automatic machine that follows the path of the track to be built, the machine having a sliding mold or "slip form" provided with two grooves for forming the channels in the slab of concrete. After the concrete has set, the rails are laid in segments in the channels, they are welded end-to-end, and they are then chocked manually to the desired height, and spaced apart to the desired gauge, with clearance being left relative to the edges of the channels. A resilient material such as resin is then cast into the channels.

That technique is fast for laying the concrete, but it suffers from the drawback of being slow for laying and chocking the rails. It is therefore confined to portions that are quite short, such as level-crossing portions.

OBJECTS AND SUMMARY OF THE INVENTION

An object of the present invention is to remedy that drawback by proposing a method of constructing a rail track on a concrete slab in which the rails can be put in place in the channels much faster.

To this end, the invention provides a method of constructing a rail track on a track-receiving concrete slab provided with channels serving to receive the rails of the rail track, wherein, after the concrete forming the track-receiving slab has set, it comprises at least the following steps:

a) the stretches of rail are put in place above the channels in the track-receiving slab, each rail having a foot coated with a casing of resilient material whose thickness is such that the foot as coated with its casing is slightly wider than the channel; and b) the foot as coated with its casing is inserted into the channel by force, the shape of the channel being suitable for reacting to the compression forces from the resilient material of the casing with a reactive force tending to hold the rail at the bottom of the channel.

In particular embodiments, the construction method of the invention may have one or more of the following characteristics, taken in isolation or in any technically feasible combination:

in an additional step c), the empty volume situated in the top portion of the channel on either side of the rail is filled with resin which seals the installation;

prior to step a), the rails in each stretch are welded together end-to-end;

at least locally, each channel has a width that tapers going from the bottom to the top of the channel;

said channels are of trapezium-shaped cross-section, the larger base of the trapezium constituting the bottom of the channel;

the edges of the channel are inclined at in the range 3° to 15° relative to the plane perpendicular to the bottom of the channel;

the casing coating the foot of each of the rails has a shape that has extra thickness of a few millimeters relative to the complementary shape of the channel;

prior to step c), a primer is deposited on the edges of the channel, and on the sides of the rail so as to improve the adhesive keying of the resin; and the track-receiving slab is obtained by casting a mass of wet concrete continuously along a determined path.

BRIEF DESCRIPTION OF THE DRAWINGS

The objects, features, and advantages of the present invention will be better understood on reading the following description of an embodiment of the invention given by way of non-limiting example, and with reference to the accompanying drawings, in which.

MORE DETAILED DESCRIPTION

Figure 1:
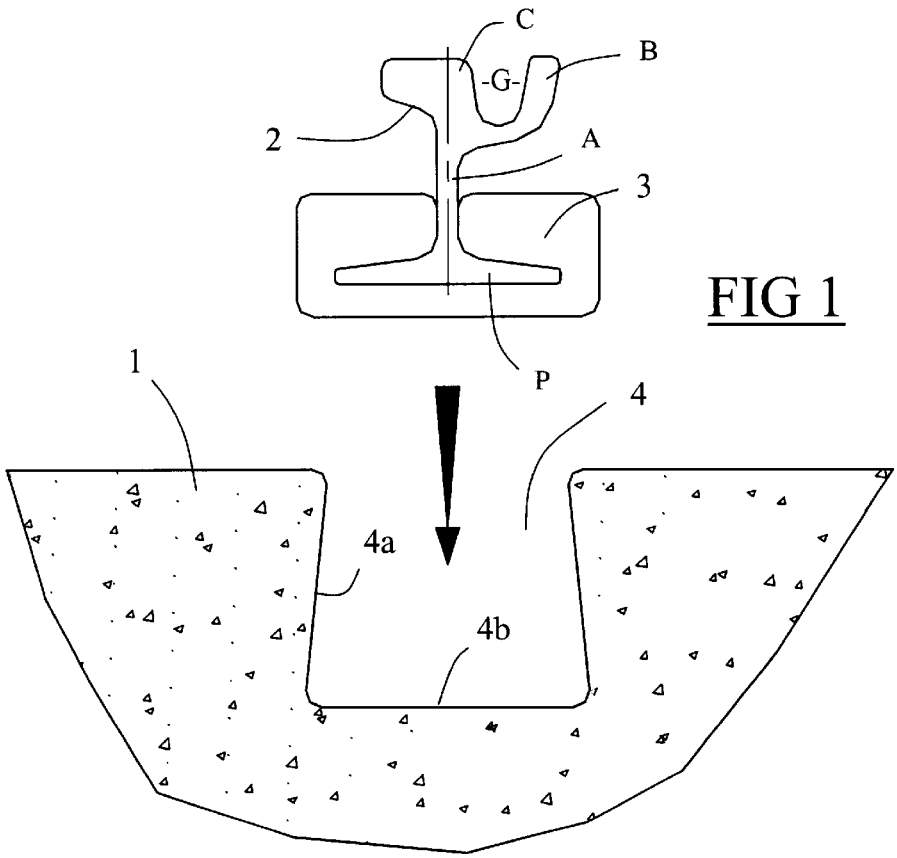
FIG. 1 is a cross-section view of a track portion, at one of the stretches of rail, diagrammatically showing a construction method in a particular implementation of the invention.

To make the drawing clearer, only those elements necessary to understanding the invention are shown.

FIG. 1 is a detail view of a track-receiving concrete slab 1 serving to receive one or more stretches of grooved rail 2. For each stretch of rail 2, the slab 1 is provided with a channel 4 delimited by side edges 4*a* and by a bottom 4*b*.

For example, the track-receiving slab 1 may be made by a construction method known to the person skilled in the art as the "slip-form" method, and it is advantageously cast on a clean subgrade (not shown in the figure). In such a method, the slab 1 is built continuously by means of a machine carrying a form and moving along the path of the rail track, wet concrete being pumped or deposited in front of the machine, the form imparting a predetermined shape to it as the machine advances. The overall shape of the concrete slab 1 is substantially rectangular, the channels 4 serving to receive the stretches of rails 2 being formed by corresponding grooves in the form.

As shown in FIG. 1, the cross-section of the channels 4 is trapezium-shaped, the side edges 4*a* being slightly inclined, e.g. by in the range 3° to 15° relative to the plane perpendicular to the bottom 4*b*, which constitutes the larger base of the trapezium.

The stretches of rails 2 are made up of a succession of rails 2 welded end-to-end, each of the rails comprising, in a manner known per se, a foot P at the bottom, a web A provided with surfaces facing in mutually opposite directions in the middle, and, at the top, a head C and a chine B that define a groove G serving to receive the flanges of the wheels of a rail vehicle.

In the invention, the foot P of each rail 2 is coated with a casing 3 of resilient material such as a synthetic rubber, e.g. a polyurethane rubber, the casing 3 being of thickness such that the foot P as equipped with its casing 3 has a width slightly larger than the width of the channel 4 at the bottom 4*b* thereof. Such a casing 3 is advantageously obtained by molding the resilient material around the foot P of the rail 2, it being possible for this molding to be performed on site, or earlier in the factory. Preferably, the casing 3 also covers part of the web A of the rail 2 while stopping beneath the shape of the head C of the rail 2, and has an outline that is substantially rectangular.

The construction method of the invention is described below with reference to FIG. 1 which shows the step of inserting the rail 2 into the channel 4, this step being performed after the concrete forming the track-receiving slab 1 has set.

As shown in FIG. 1, the stretch of rail 2 is brought above the channel 4 by means of a gantry (not shown), and the rail 2 is lowered gradually onto the channel 4 until the bottom face of the casing 3 coating the foot P comes flush with the top surface of the track-receiving slab 1.

Figure 2:
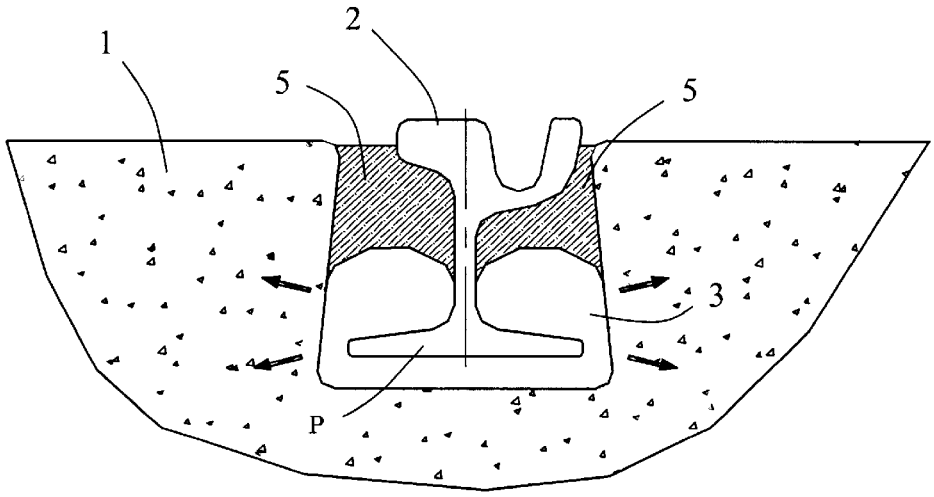
FIG. 2 is a cross-section view of the track portion built by implementing the method of FIG. 1.

A force is then applied locally and vertically downwards, e.g. by means of a pressure wheel bearing on the rail 2 in order to insert the foot P of the rail 2 into the channel 4 by force, the edges of the casing 3 then being compressed against the side edges 4*a* of the channel 4 while generating compressive forces shown by arrows in FIG. 2. Because of the trapezium shape of the channel 4, the reaction forces exerted by the side edges 4*a* on the casing then tend to center the rail 2 in the channel 4, and the resultant of these reaction forces has a downward vertical component that holds the rail 2 at the bottom of the groove 4, thereby achieving initial locking of the rail 2 in the channel 4.

As shown in FIG. 2, once the insertion operation has been effected, the empty volume disposed on either side of the rail 2 in the top portion of the channel 4 is filled with a resin 5 such as a polyurethane resin, which resin comes to adhere to the rails 2 and to the edges 4*a* of the channel 4, it being possible advantageously for the adhesive keying of the resin 5 to be reinforced by applying a primer to the concrete edges of the channel 4 and to the sides of the rail 2. The resin 5 setting participates in finally locking the rail 2 in its channel 4, and the resin also contributes to preventing water from penetrating into the installation, thereby protecting it from frost. Such a resin 5 also provides reinforced electrical insulation and protects the underlying casing 3.

Such a method of construction offers the advantage of making it possible to accelerate the rate at which the rails are laid in the channels, and thus of reducing the time required to construct the rail tracks. In addition, accurate positioning of the rails within the channels is achieved automatically by co-operation between the compression forces from the resin and the shape of the channel, thereby making it possible to omit any rail adjustment operation.

Naturally, the invention is in no way limited to the embodiment described and shown, which is given merely by way of example. Modifications remain possible, in particular concerning the make up of the various elements, or the use of equivalent substitute techniques, without going beyond the scope of protection of the invention.

Thus, the above-described figures show a method of constructing a rail track provided with grooved rails, but the method of the invention is also applicable to constructing rail tracks provided with rails of the standard flat-bottomed rail type having a head that is substantially cylindrical, by allowing the head of the rail to project above the top level of the slab, or by leaving an empty space in one side of the channel for the flanges of the wheels of the rail vehicle.

What is claimed is:

1. A method of constructing a rail track on a track-receiving concrete slab provided with channels serving to receive rails of the rail track, wherein, after the concrete forming the track-receiving slab has set, said method comprising:

a) putting stretches of the rails in place above the channels in the track-receiving slab, each rail having a foot coated with a casing of resilient material whose thickness is such that the foot as coated with its casing is slightly wider than the channel;

b) inserting the foot as coated with its casing into the channel by force, the shape of the channel being suitable for reacting to the compression forces from the resilient material of the casing with a reactive force tending to hold the rail at the bottom of the channel; and c) filling the empty volume situated in the top portion of the channel on either side of the rails with resin which seals the installation.

2. A method of constructing a rail track according to claim 1, wherein, prior to step a), the rails in each stretch are welded together end-to-end.

3. A method of constructing a rail track according to claim 1, wherein, at least locally, each channel has a width that tapers going from the bottom to the top of the channel.

4. A method of constructing a rail track according to claim 3, wherein said channels are of trapezium-shaped cross-section, the larger base of the trapezium constituting the bottom of the channel.

5. A method of constructing a rail track according to claim 4, wherein the edges of the channel are inclined at in the range of 30° to 15° relative to the plane perpendicular to the bottom of the channel.

6. A method of constructing a rail track according to claim 1, wherein the casing coating the foot of each of the rails has a shape that has extra thickness of a few millimeters relative to the complementary shape of the channel.

7. A method of constructing a rail track according to claim 1, wherein, prior to step c), a primer is deposited on the edges of the channel, and on the sides of the rail so as to improve the adhesive keying of the resin.

8. A method of constructing a rail track according to claim 1, wherein the track-receiving slab is obtained by casting a mass of wet concrete continuously along a determined path.

* * * * *